United States Patent [19]

Cecil

[11] 4,071,276

[45] Jan. 31, 1978

[54] RECLINER CHAIRS

[75] Inventor: Nelson Lothair Cecil, Thomasville, N.C.

[73] Assignee: Royal Development Company, Inc., High Point, N.C.

[21] Appl. No.: 768,742

[22] Filed: Feb. 15, 1977

[51] Int. Cl.[2] ..... A47C 1/02

[52] U.S. Cl. ..... 297/85; 297/270; 297/271; 297/DIG. 7

[58] Field of Search ..... 297/85, 69, 83, 84, 297/264, 270, 271, DIG. 7

[56] References Cited

U.S. PATENT DOCUMENTS

| | | | |
|---|---|---|---|
| 3,352,601 | 11/1967 | Cycowicz | 297/85 |
| 3,550,952 | 12/1970 | Ferguson | 297/85 |
| 3,638,995 | 2/1972 | Flannagan | 297/DIG. 7 |
| 3,768,859 | 10/1973 | Rogers | 297/DIG. 7 |

*Primary Examiner*—James T. McCall
*Attorney, Agent, or Firm*—William E. Mouzavires

[57] ABSTRACT

Improvements in a rocker recliner chair which permit the backrest to be moved to an initial, relatively slight reclining position without having to first extend the footrest from retracted to extended position, however, in order to continue to move the backrest into a full recline position into an advanced or full recline position, the footrest must be extended which is effected through a manually operated handle connected to the footrest linkage. The foregoing sequencing and control is achieved by a linkage interconnecting the footrest linkage and the linkage which serves to mount the seat relative to the base which, in the preferred embodiment of the invention, includes a rocker frame.

7 Claims, 5 Drawing Figures

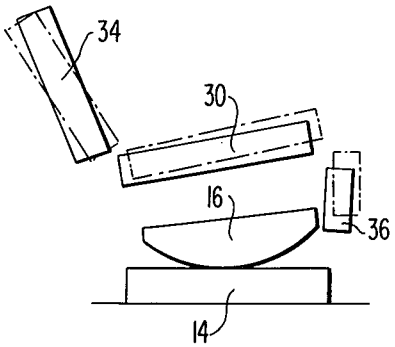
FIG I
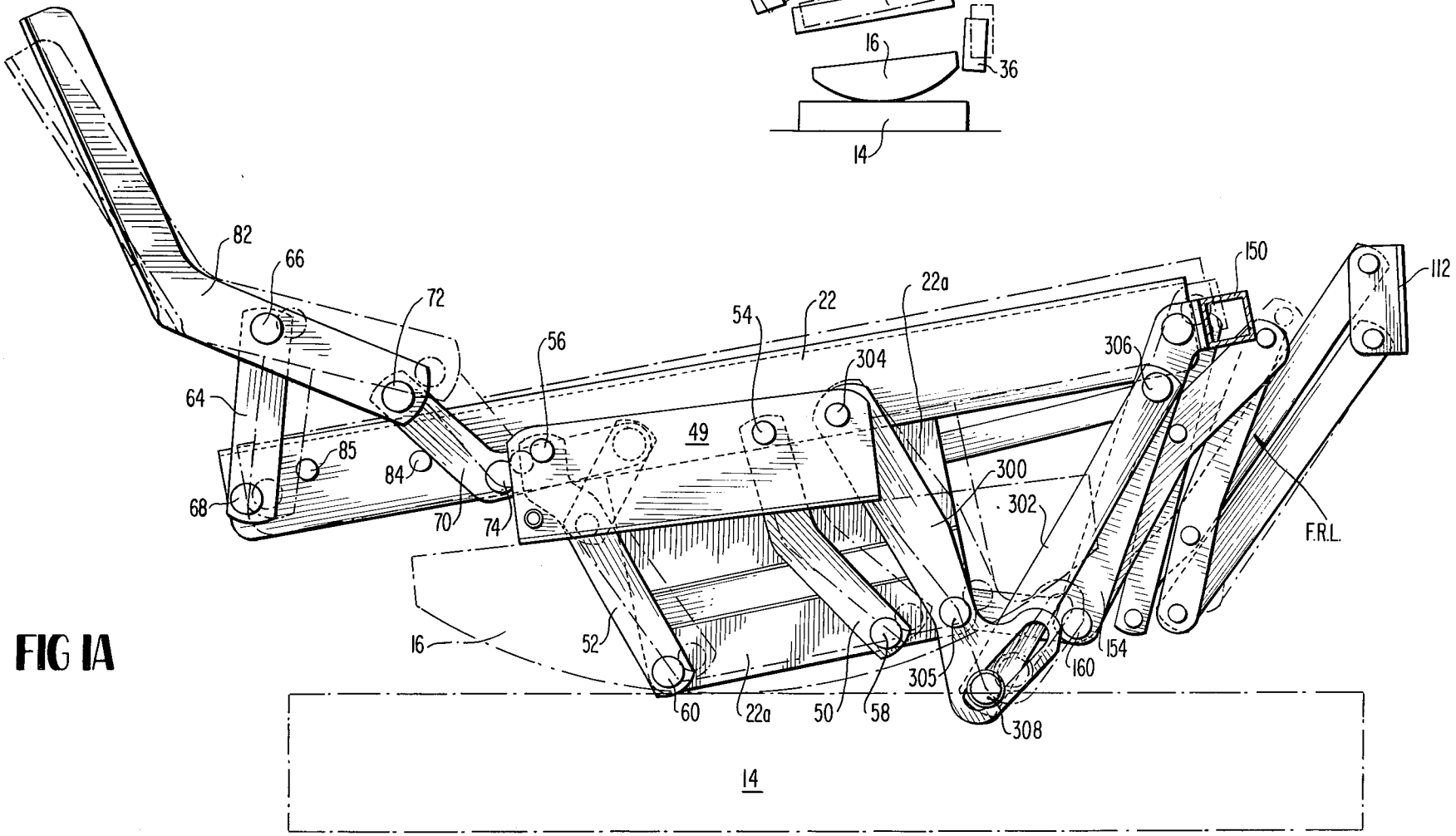
FIG IA

RECLINER CHAIRS

RELATED PATENT

Although not limited thereto, the present invention constitutes improvements in a chair such as, for example, disclosed in U.S. Pat. No. 3,730,585 assigned to the assignee of the subject application. Where necessary, the disclosure of U.S. Pat. No. 3,730,585 is incorporated by reference into the subject application.

SUMMARY OF INVENTION

The present invention relates to improvements in recliner chairs of the type, for example, shown in U.S. Pat. No. 3,730,585 identified above. Such chairs include a base which may include a rocker frame; a seat including a seat linkage mounting the seat relative to the rocker frame for reclining movement; a backrest including backrest linkage mounted relative to the seat for movement between generally upright and reclining positions; and a footrest incuding footrest linkage mounted to the seat for movement between extended and retracted positions. In a preferred embodiment, a manually operated handle mounted relative to the seat is provided for actuating the footrest between its extended and retracted positions.

Specifically, the present invention constitutes an improvement in a chair such as just described wherein the backrest may be moved from an upright to an initial, slightly reclined position without having to first extend the footrest from the retracted to extended position. However, in order to proceed from this initial reclining position to advanced or full recline positions, the present invention maintains the desired requirement that the footrest be extended first before allowing such advanced reclining movement.

The above feature of the present invention is achieved through a sequencing and control linkage which interconnects the footrest linkage and the seat linkage. This sequencing and control linkage, which includes a lost motion connection, allows the slight reclining movement of the chair as stated when the footrest is retracted. However, in order to move the chair into advanced reclining positions including the full recline position, it is necessary to actuate the sequencing linkage and this is effected through the footrest linkage when the footrest is moved from retracted to extended position.

DRAWINGS

Other objects and advantages of the present invention as well as a complete description thereof will become apparent from the following detailed description taken in conjunction with the drawings in which:

FIG. 1 is a side view of a rocker recliner chair in schematic form illustrating the basic parts thereof and two different positions, one position being the normal or generally upright position of the chair and the other position shown in phantom lines being a slightly reclined position with the footrest still retracted;

FIG. 1A is a side view of a linkage system incorporating the improvements of the present invention and shown together with certain parts of an associated chair in two different positions corresponding to those illustrated in FIG. 1; it being understood that certain parts of the chair have been omitted for clarity;

DETAILED DESCRIPTION

Figure 2:
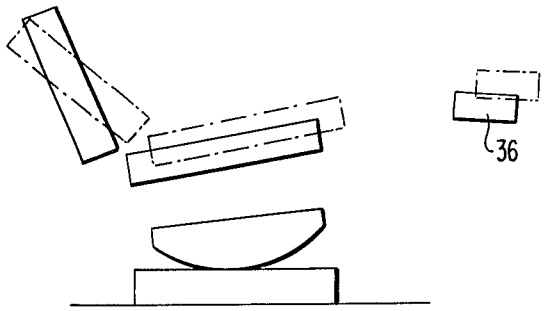
FIG. 2 is a view generally similar to FIG. 1 except that it illustrates the basic parts of the chair when in TV position with the footrest position extended, and the full recline position (in phantom) during which the footrest remains extended.

Referring now to the drawings in detail, there is shown for illustrative purposes, a rocker recliner chair and linkage system generally similar to that disclosed in U.S. Pat. No. 3,730,585. However, the presently disclosed linkage system incorporates certain improvements in accordance with the present invention which enable the chair to meet certain requirements. Referring to FIG. 1, there is schematically shown a threeway rocker recliner chair which may incorporate the improved linkage system of the present invention. This chair includes a base frame 14 which, of course, is stationary; a rocker cam 16 mounted on the base frame 14 for typical rocking movement; a seat 30 which includes armrests, not shown, mounted on the rocker cam 16 for rocking movement as well as for reclining movement relative to the cam 16 and base frame 14 by a seat linkage to be described below; a backrest 34 mounted relative to the seat 30 for movement relative thereto between generally upright and reclining positions by means of a backrest linkage to be described below; and a footrest 36 mounted relative to the front of the seat 30 for movement between retracted and extended positions by means of a footrest linkage to be described below. A more complete description of the parts just described, including the frame portions, the rocker cams and rocker springs, may be found in U.S. Pat. No. 3,730,585 whose disclosure has been incorporated by reference in this application.

Figure 2B:
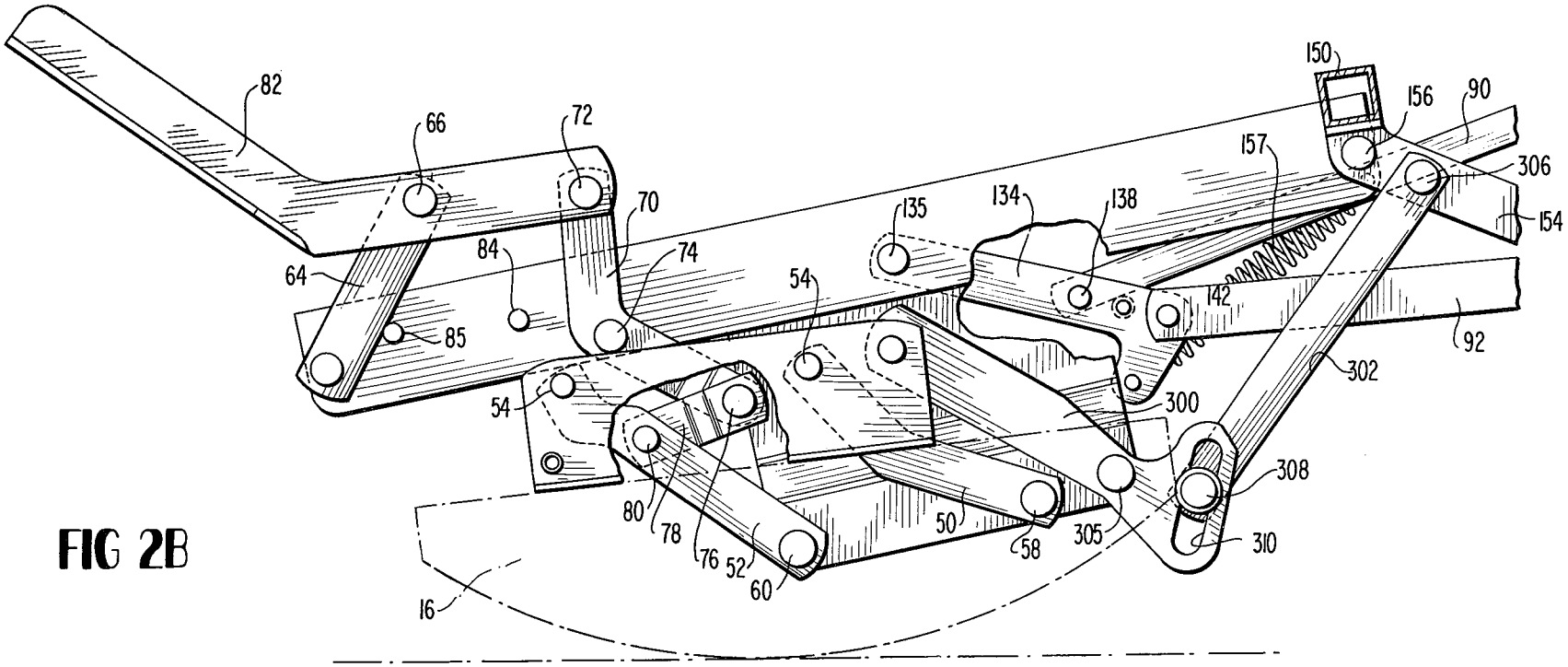
FIG. 2B is a view generally similar to FIG. 2A but only showing the full recline position of the linkage and with certain parts broken away for clarity.
Figure 2A:
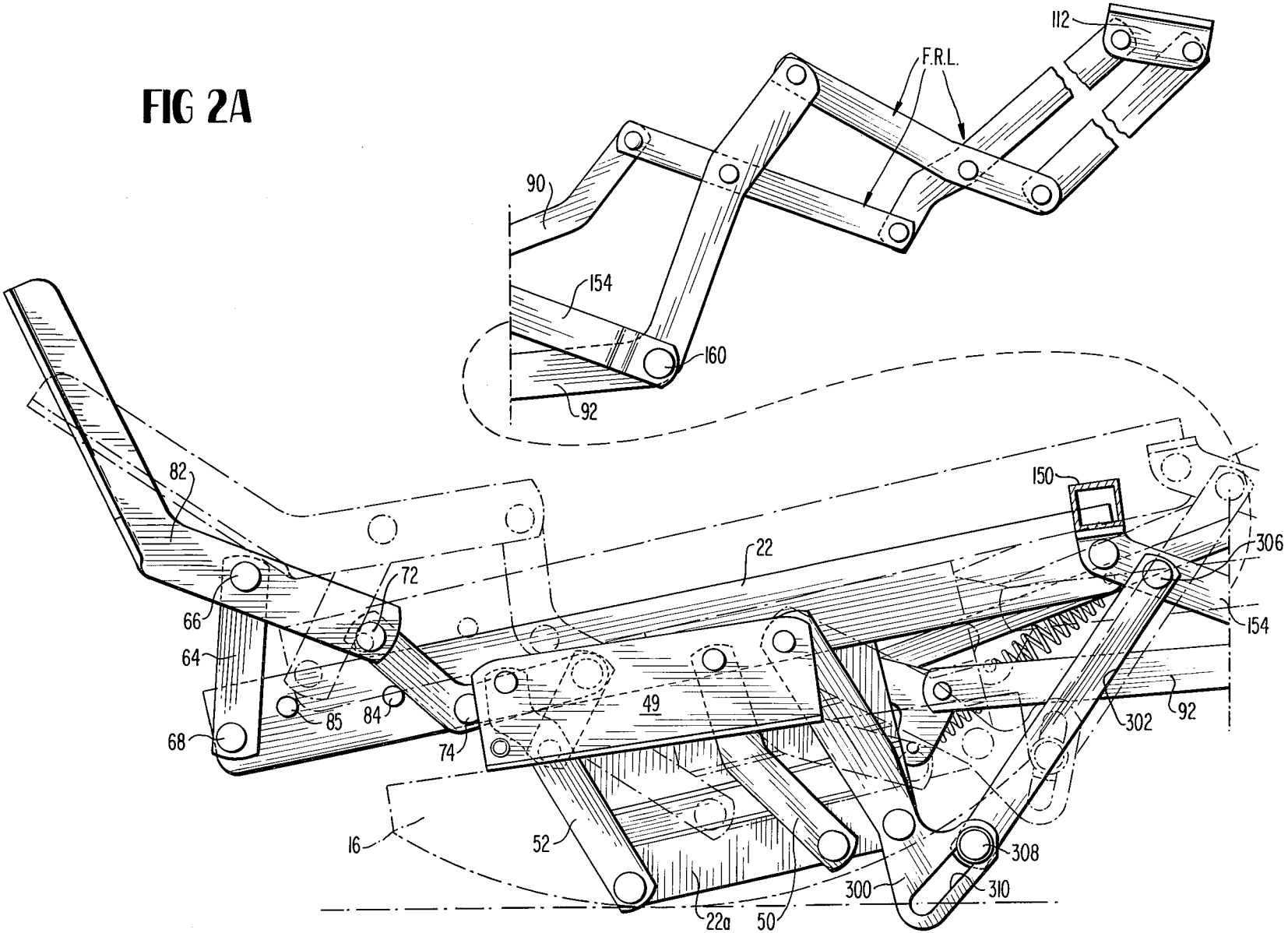
FIG. 2A is a view generally similar to FIG. 1A except that the linkage system is shown in the TV position and the full recline position (in phantom) corresponding to the positions shown in FIG. 2.

Referring now to FIGS. 1A, 2A and 2B, there is shown one side of an improved linkage system to be utilized together with the chair parts described above in connection with FIG. 1. It should be understood that the chair incorporates two linkage systems at opposite sides of the chair, which linkage systems are mirror images of each other but that the ensuing description and the drawings cover one of the linkage systems on one side of the chair.

The linkage system disclosed includes a seat link 22 which extends forwardly and rearwardly along and is fixed to the seat frame 30 so as to be part of the latter. Seat link 22 includes, at an intermediate portion thereof, a rigid depending mounting portion 22*a* shown as having a generally rectangular outline. Seat 30 is mounted for movement relative to the associated rocker cam 16 by means of seat mounting links 50 and 52 having their upper ends pivoted at 54 and 56, respectively, to the rocker cams by means of a bracket 49 which is fixed to the top of the rocker cam 16. The lower ends of seat mounting links 50 and 52 are pivoted at pivots 58 and 60, respectively, to seat link portion 22*a*.

Backrest 34 is mounted to the seat by means of the backrest linkage which includes a backrest link 82 adapted to be fixed to the backrest frame 34 along the side thereof; a short link 64 pivoted at 66 to the backrest link 82 and pivoted at 68 to the seat link 22. In addition, the backrest linkage includes a link 70 shown in the form of a crank pivoted at 72 to the lower end of backrest mounting link 82 and mounted intermediate its ends at pivot 74 to seat link 22. Movement of seat 30 relative to the base between generally upright and reclining positions is achieved through link 70 which is connected to rear seat mounting link 52 through means of a short link 78. As clearly shown in FIG. 2B, short link 78 is pivoted at 76 to the end of link 70 and pivoted at 80 to an intermediate portion of rear seat mounting link 52.

Footrest 36 is mounted to the front of the seat 30 for movement between a retracted position shown in FIG. 1 and an extended position shown in FIG. 2 through means of a footrest linkage including a bracket 112 which is adapted to be fixed to the footrest to move together with it. Connected to bracket 112 is an accordian-type linkage further included in the footrest linkage, this accordian linkage being generally designated as FRL in FIGS. 1A and 2A of the drawings. The footrest linkage further includes extension links 90 and 92 having their inner extremities pivotally connected by pivots 138 and 142 to a footrest mounting link 134 as best shown in FIG. 2B. Footrest mounting link 134 is pivoted by pivot 135 to seat link 22. The footrest linkage further includes another mounting link 154 pivoted at its upper end by pivot 156 to the forward portion of seat link 22 and pivoted at its lower end by pivot 160 to a bend portion of extension link 92 as shown in FIGS. 1A and 2A.

Actuation of the footrest linkage to extend and retract footrest 36 is achieved through a manual control handle (not shown) which is mounted to the seat linkage on the side of the chair opposite to the linkage system shown in the drawings. The operating handle is connected to a link similar to footrest mounting link 134, and the associated footrest linkage is connected by a cross rod 150 to the footrest linkage on the side of the chair shown in the drawings so that motion is transmitted from the footrest linkage actuated through the control handle to the footrest linkage shown in the drawings to extend and retract the footrest. A more complete description of the footrest operating handle and cross rod 150 may be obtained by reference to the aforementioned U.S. Pat. No. 3,730,585; it being understood that the linkage system heretofore described forms no part of the present invention and generally conforms to that disclosed in U.S. Pat. No. 3,730,585.

In accordance with the present invention, a novel sequencing and control linkage is provided to allow the chair to be moved to an initial, relatively slight reclining position without extension of the footrest, that is, when the footrest is retracted. This linkage includes a first control link 300 having its upper end pivoted by pivot 304 to bracket 49 which, as described above, is fixed to the top of rocker cam 16. A lower end portion of link 300 is pivoted by pivot 305 to the lower part **22*a* of seat link 22. The lower extremity of link 300 is slightly cranked and is provided with an elongated slot 310 which receives a pin 308 fixed to the lower end of a second control link 302 whose upper end is pivoted by pivot 306 to the footrest mounting link 154**.

When the chair is in the normal generally upright position with the footrest retracted, the parts are in the position shown in solid lines in FIG. 1A. At this time, pin 308 of link 302 is at the bottom portion of slot 310 in link 300, as clearly shown. In this condition, if the chair occupant wishes to slightly recline, he merely exerts back pressure on the backrest, and backrest links 64 and 70 will pivot clockwise as shown in FIG. 1A to the phantom line position shown in FIG. 1A. This will have the effect of moving the seat forwardly with the forward part of the seat moving upwardly as shown by the phantom lines in FIG. 1A. This movement of the backrest and seat relative to the base and rocker cam 16 is permitted by slot 310 which permits link 300 to pivot into the phantom line position shown in FIG. 1A; pin 308 of link 302 now being positioned intermediate the ends of slot 310 as shown by the phantom lines in FIG. 1A. However, further reclining movement of the backrest from the position just indicated will not be permitted by link 302 unless the footrest is moved to extended position from the retracted position shown in FIG. 1A.

When the footrest is moved to extended position which is shown in the solid lines in FIG. 2A, this will cause link 302 to move relative to link 300 with pin 308 moving upwardly in slot 310 where it eventually is positioned in the upper end of the slot 310 as shown clearly in FIG. 2A. This will have the effect of freeing link 300 for movement such that if the chair occupant wishes to move to a further reclined position such as illustrated by the phantom lines in FIG. 2A which illustrate the full recline position, the seat linkage including links 50 and 52 will be free to move to the phantom line position shown in FIG. 2A under actuation of link 70 included in the backrest linkage.

Movement to the full recline position will result in the pin 308 being positioned in intermediate portion of slot 310 as shown in the phantom lines in FIG. 2A and in the full solid lines in FIG. 2B. The chair occupant, when the footrest is extended, is free to move between the reclined position shown in solid lines in FIG. 2A and the fully reclined position shown in solid lines in FIG. 2B and during such movement, pin 308 will be free to move along the upper portion of slot 310. Movement of the backrest to the full recline position is limited by the stop 85 which is engaged by short link 64 as shown in FIG. 2B. In order to return the chair from the full recline position to the normal upright position, the chair occupant merely releases pressure on backrest 34 and this redistribution of the weight will cause links 50, 52 to return the chair to the TV position shown in FIG. 2A at which point the footrest may be retracted in the manner indicated above. In the normal or upright position of the chair forward movement of the backrest relative to the seat is limited by stop 84 engaged by seat link 22 as shown in FIG. 1A.

Although the improvement of the present invention has been shown and described in connection with a specific rocker recliner chair, it is also applicable to other types of recliner chairs including those which are not rockers but which incorporate a seat which is movable relative to the base and a backrest which is movable relative to the seat.

In addition and although not shown in the specific embodiment shown, a lock mechanism may be provided for preventing rocking movement of the chair when the footrest is extended. One such lock mechanism that may be utilized is disclosed in U.S. Pat. No. 3,730,585 and therefore need not be described here, it being understood that it forms no part of the present invention.

What is claimed is:

1. A reclining chair including a base, a seat, seat linkage mounting the seat for movement relative to the base, a backrest, backrest linkage mounting the backrest to and for movement relative to the seat between a generally upright position and a number of reclining positions, a footrest, footrest linkage mounting the footrest to the seat for movement between a retracted position adjacent the seat and an extended position projected forwardly from the seat, sequencing and control linkage connected between the footrest linkage and the seat for permitting the backrest and the seat to be moved to an initial reclining position relative to the base while the footrest is in retracted position but preventing further movement of the backrest to a reclining position advanced from said initial position unless the footrest is moved to extended position, and wherein said sequencing and control linkage includes a first control link pivoted relative to the seat, a second control link pivoted to the footrest linkage and a lost motion connecting means interconnecting said first and second control links, and wherein said lost motion connecting means includes a pin fixed to one of said control links and a slot on the other of said control links receiving said pin, the pin being movable in said slot, and wherein said first control link is also pivotally connected relative to said base, and wherein said footrest linkage includes a footrest mounting link pivotally mounted relative to the seat linkage and wherein said second control link is pivotally connected to said footrest mounting link.

2. A reclining chair including a base, a seat, seat linkage mounting the seat for movement relative to the base, a backrest, backrest linkage mounting the backrest to and for movement relative to the seat between a generally upright position and a number of reclining positions, a footrest, footrest linkage mounting the footrest to the seat for movement between a retracted position adjacent the seat and an extended position projected forwardly from the seat, the footrest linkage including means for extending and retracting the footrest independently of the backrest, sequencing and control linkage connected between the footrest linkage and the seat for permitting the backrest and the seat to be moved to an initial reclining position relative to the base while the footrest is in retracted position but preventing further movement of the backrest to a reclining position advanced from said initial position unless the footrest is moved to extended position, and wherein said sequencing and control linkage includes a first control link pivoted relative to the seat, a second control link pivoted to the footrest linkage and a lost motion connecting means interconnecting said first and second control links, and wherein said first control link is also pivotally connected relative to said base.

3. The chair defined in claim 2 wherein said lost motion connecting means includes a pin fixed to one of said control links and a slot on the other of said control links receiving said pin, the pin being movable in said slot.

4. The chair defined in claim 2 wherein said footrest linkage includes a footrest mounting link pivotally mounted relative to the seat linkage and wherein said second control link is pivotally connected to said footrest mounting link.

5. The chair defined in claim 3 wherein said first control link is also pivotally connected relative to said base.

6. The chair defined in claim 5 wherein said base includes a rocker cam and wherein said seat linkage is mounted to the rocker cam.

7. The chair defined in claim 6 wherein said means for extending and retracting the footrest includes a handle-operated linkage.

* * * * *